US005976589A

United States Patent [19]

Desjardins

[11] Patent Number: 5,976,589

[45] Date of Patent: Nov. 2, 1999

[54] METHOD OF FORMING A PACKAGED FOOD PRODUCT

[76] Inventor: André Desjardins, 184, rue Desjardins, app. 4, Magog, Canada, J1X 5X3

[21] Appl. No.: 08/959,171

[22] Filed: Oct. 28, 1997

Related U.S. Application Data

[63] Continuation-in-part of application No. 08/781,006, Jan. 9, 1997, Pat. No. 5,786,011.

[51] Int. Cl.[6] ..... B65D 85/00

[52] U.S. Cl. ..... 426/119; 426/106; 426/115; 426/122; 206/545; 220/266

[58] Field of Search ..... 426/115, 119, 426/106, 122, 130, 120; 206/523, 545; 220/265, 266, 270, 276

[56] References Cited

U.S. PATENT DOCUMENTS 5,110,038 5/1992 Pantisano et al. ..... 426/115

*Primary Examiner*—Lien Tran

[57] ABSTRACT

The package includes a container and a lid therefor, both made of a thermal insulating foam material. The container has a line of weakening extending across the bottom wall and the side wall of the container to permit breaking of the latter into two parts across the cavity. The line of weakening is disposed in a plane which is normal to the bottom wall and which is located in the area of maximum width of the cavity. The container serves as a mould for a flowable settable food product which, once set, is readily available for eating by breaking the container across the cavity. The food product is normally ice cream and a release film surrounds the same within the cavity. One or more cavities may be provided in the same container. The lid seals each cavity independently of the others.

4 Claims, 4 Drawing Sheets

METHOD OF FORMING A PACKAGED FOOD PRODUCT

CROSS-REFERENCE TO RELATED APPLICATION

This application is a continuation-in-part of U.S. patent application Ser. No. 08/781,006 of A. Desjardins filed on Jan. 9, 1997 now U.S. Pat. No. 5,786,011.

FIELD OF THE INVENTION

This invention relates to a food product package, to a packaged food product package and to the method of packaging the food product.

OBJECTS OF THE INVENTION

It is an object of the invention to provide one or several individual portions of a flowable and settable food product such as ice cream in a single container which serves both as a production mould and a package which can be easily broken to render the food product accessible to the user.

It is a further object to provide a container and a lids for several individual food portions, each portion being independently accessible the remaining portions kept sealed by the lids.

It is a further object to provide a new method of packaging a flowable and settable food product such as ice cream.

SUMMARY OF THE INVENTION

According to the main aspect of the present invention, there is provided a package for a flowable and settable food product comprising a container having a bottom and a side wall to define the surface of a cavity open at the top, and a lid for removably closing the container, both the container and the lid made of a thermal insulating material, the container having an insulating material weakening line extending across the cavity and made in the bottom wall and in the side wall to permit breaking the container into two parts across the cavity.

According to a further aspect of the present invention, there is provided a container for a food product comprising:

a central section;

a plurality of peripheral sections linked to the central section by a weakening line allowing for an easy detachment of the peripheral sections from the central section;

a plurality of cavities overlapping the central section and each one of the peripheral sections; each of these cavities, defined by a wall and a bottom, is designed to accommodate one portion of a food product. Each cavity is of any desired geometrical shape and is divided in two parts by a weakening line, which allows for easy removal of a food portion from a selected container cavity after the detachment of the peripheral section of the selected cavity.

The weakening line of this invention is continuous and runs across the bottom and side wall of each cavity being preferably located in a plane perpendicular to the bottom of the cavity and across the maximum width of the cavity. The weakening line is preferably a V-shaped groove made in the bottom wall and extended by slits through the side wall to facilitate detachment.

The lid of the present invention totally covers the container and closes the cavity or cavities and has a depending flange to overlap the container and prevent accidental breaking of the container along the weakening line or lines.

The container can also contain a retaining means to keep the peripheral sections from falling after detachment and to allow a repositioning of the peripheral sections in place in order to ensure extended preservation of the food portions into the cavities after putting back the lid onto the container. Each retaining means is preferably an adhesive tape bonded to both the central section and one of the peripheral sections along the groove and onto the external surface of the container bottom, the tape thus acting as a hinge between the two sections.

According to a further aspect of the present invention, the body acts as a mold permitting the setting of the flowable food product. Therefore, the container serves as packaging as well as a mold for the preparation of the food product.

The material forming the container and the lid is a thermally insulating material preferably as a closed cell food grade foam material. Such materials are well known in the art and readily available.

According to a further aspect of the present invention, there is provided a packaged food product comprising the above defined container, lid and food product. Preferably, a releasable film material completely surrounds the food product within the cavity closed by the lid to facilitate opening of the lid and release of the food product from the container cavity.

According to a further aspect of the present invention, there is defined a method of filling a packaged food containing the steps of:

a) supplying a container having a bottom wall and a side wall to define the surface of a cavity opened at the top and a lid for removably closing the container, both the container and the lid made of a thermal insulating material, the container having an insulating material weakening line extending across the cavity and made in the bottom wall and in the side wall to permit breaking of the container into two parts across the cavity;

b) placing a food release film material adjacent the cavity surface;

c) filling the cavity with a flowable, settable food product;

d) placing an additional food release film material on top of the food product; and e) closing the container with the lid.

Preferably, the method further includes, after step c), a step of topping the food product with a decorative granular food material and causing, during step e), an inner surface of the lid to engage the additional food release film material against the decorative food material to retain the latter in place.

The method is particularly applicable to ice cream.

Having thus generally described the invention, reference will be made to the accompanying drawings illustrating the preferred embodiments thereof and in which like reference characters indicate like elements throughout.

DETAILED DESCRIPTION OF THE PREFERRED EMBODIMENTS

Figure 1:
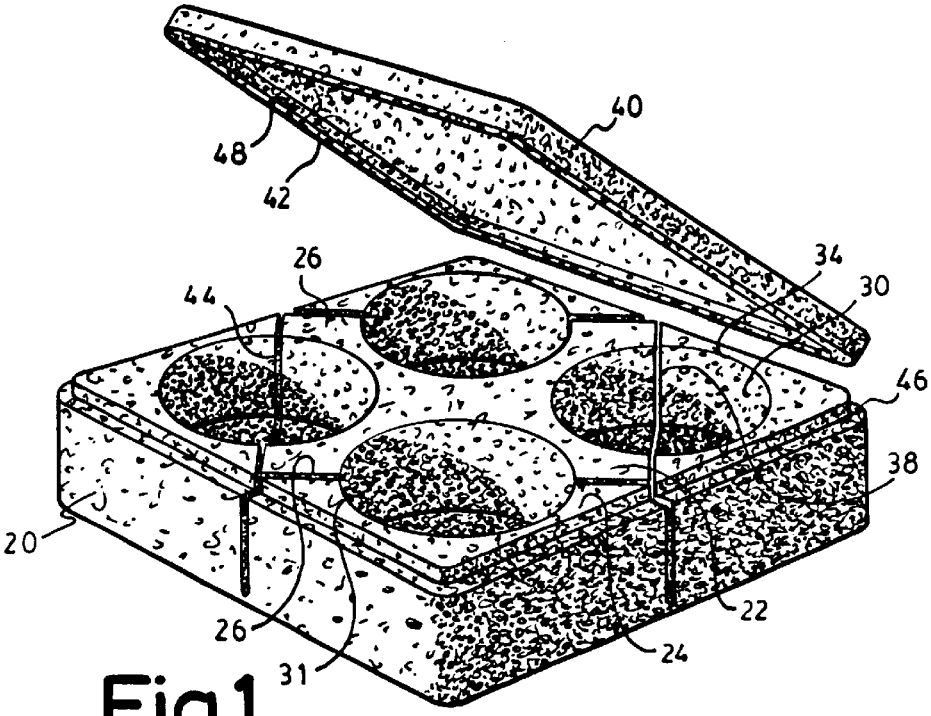
FIG. 1 is a view in perspective of a first embodiment of the food product container and its lid.
Figure 2:
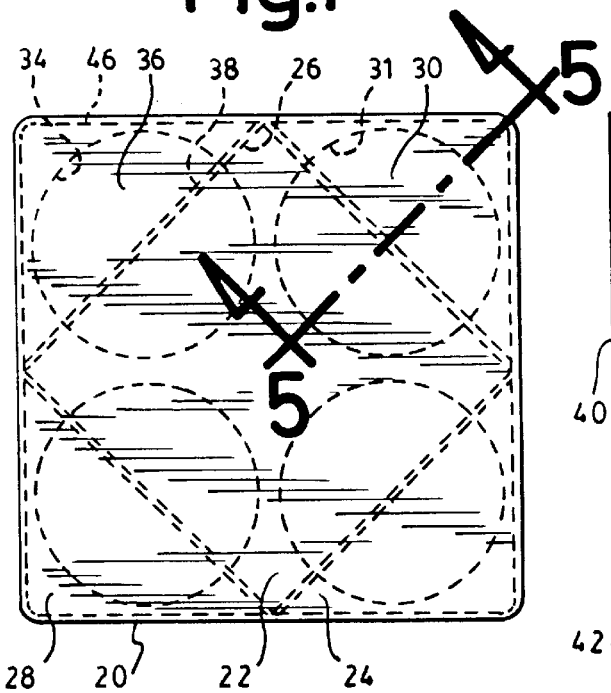
FIG. 2 is a plan view of the food product container of FIG. 1.
Figure 3:
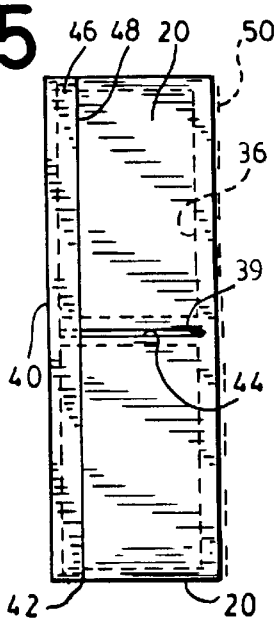
FIG. 3 is a side view of the food product container and lid of FIG. 1.

A preferred embodiment of the present invention is illustrated in FIGS. 1, 2, and 3 and serves to package a food product 32 such as ice cream.

A container 20 and its removable lid 40 are both made of a thermal insulating material, preferably closed cell food grade foam, and both are rectangular in shape. Container 20 forms four cavities 30 and is composed of a central section 22 and four peripheral sections 24. The peripheral sections 24 are located at the periphery of container 20. The peripheral sections 24 are divided from the central section 22 by a line of weakening 26 allowing for easy detachment of the peripheral sections 24 from the central section 22. Each peripheral section 24 has a grip means 28 for fingers, preferably on top of each peripheral section 24 on tope of container 20, being as far away as possible from the central section 22 to allow for the best leverage, the best grip of the peripheral section 24 for its detachment from central section 22.

Lid 40 covers container 20 and is attached thereto by an attachment means 42. The attachment means is, preferably, a counterbore 46 encircling the periphery of container 20, and a flange 48 which completely surrounds the periphery of lid 40 and which engages counterbore 46.

Each cavity 30 overlaps the central section 22 and one of the peripheral sections 24. The cavities 30 are comprised of walls 34 attached to a bottom 36. The walls of the cavities 30 located in the peripheral sections 24 separate the cavities 24 from the exterior of container 20. The line of weakening 26 for each cavity 30 is preferably a groove 38 inscribed in the internal surface of bottom 36 (see FIG. 5) and two extended by slits 44 made through wall 34 on opposite sides of the cavity. Groove 38 and the two slits 44 form a continuous line of weakening made through walls 34 and 36 and located in a plane which separates the central section 22 from one of the peripheral sections 24, and is perpendicular to the bottom 36 of the cavity 30. This plane divides the geometrical shape 31 of the cavity 30 into two parts. This separation plane preferably coincides with the maximum width of the geometrical shape 31 of the cavity 30, so as to permit easy removal of the food product 32 from its cavity 30.

The embodiment of FIGS. 1 to 3 shows flange 48 which completely surrounds the periphery of the lid directly engaging over the counterbore or shoulder 46 at the periphery of container 20.

Figure 4:
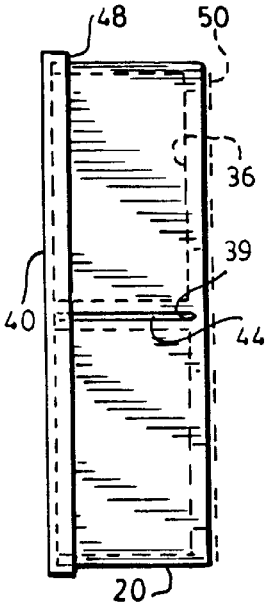
FIG. 4 is a side view of a second embodiment of the food product container and its lid.

In the embodiment of FIG. 4, there is no shoulder 46 and flange 48 engages over the external surface of the container wall.

Figure 6:
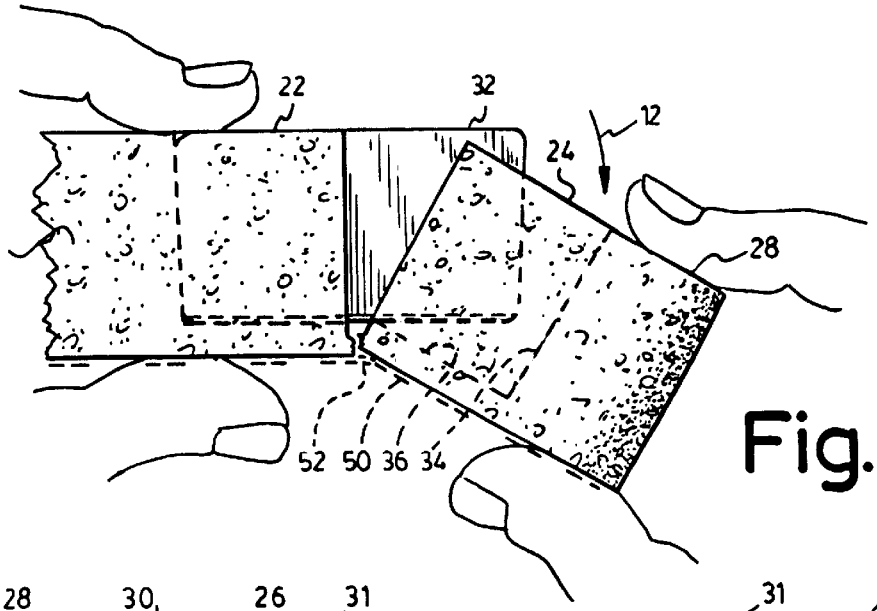
FIG. 6 is a partial side view of the container of FIG. 5 and illustrating the removal of the food product.

In FIGS. 3 and 4 one may see retaining means 50 bonded onto the side of container 20 opposite the lid 40. These retaining means 50, preferably an adhesive tape, form hinges 52 which keep the peripheral sections 24 from falling off the central section 22 after detachment indicated by arrow 12 as illustrated in FIG. 6. Hinges 52 enable pivoting the detached sections 24 back into its original position and putting back of the lid 40 on the container 20 with flange 48 holding section 24 in the original position. This ensures extended preservation of the remaining part of the food product 32 in the opened cavity 30.

Figure 5:
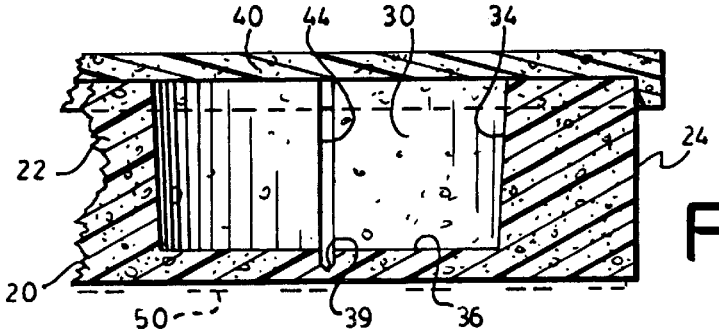
FIG. 5 is a partial cross-section along line 5—5 of FIG. 2.

In FIG. 5, it will be noted that the walls 34 of the cavity 30 are slightly upwardly flaring to facilitate molding of container 20. The grooves 38 have preferably a V-shaped bottom 39, so as to avoid any damage to the food product 32 in the process of detachment.

Figure 7:
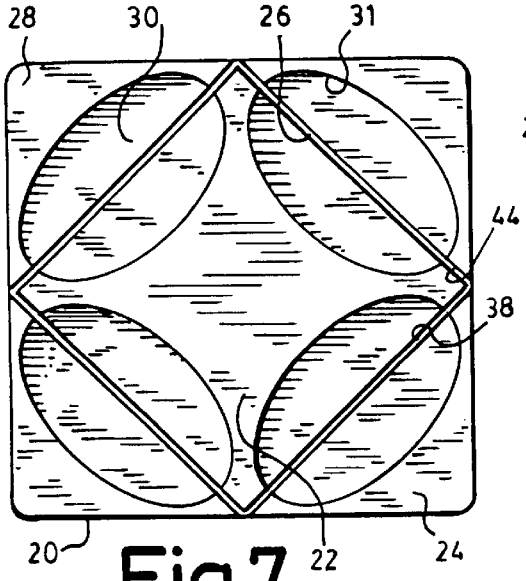
FIGS. 7 and 8 are plan views of food product containers similar to the container of FIGS. 4 to 6.
Figure 8:
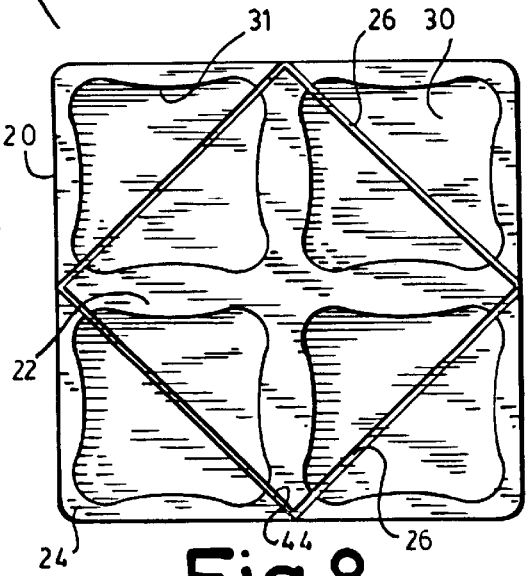

The cavities 30 can take a plurality of geometrical shapes 31 as illustrated in FIGS. 7 and 8. Circular forms 31 are preferred.

To further facilitate food product removal, the plane containing a line of weakening 26 is located in the area of maximum width of cavity 30. In all the embodiments slits 44 may be replaced by a score line at the inner surface of the cavity 30 with such a depth that the breaking resistance of the foam material remaining across the score line will be insufficient to prevent easy detaching pivotal movement in accordance with arrow 12 of FIG. 6 while limiting heat transfer therethrough as compared to slits 44.

As shown in FIG. 5, the underside of lid 40 rests directly on the top of container 20 so as to seal each cavity 30 independently of the others.

Figure 5A:
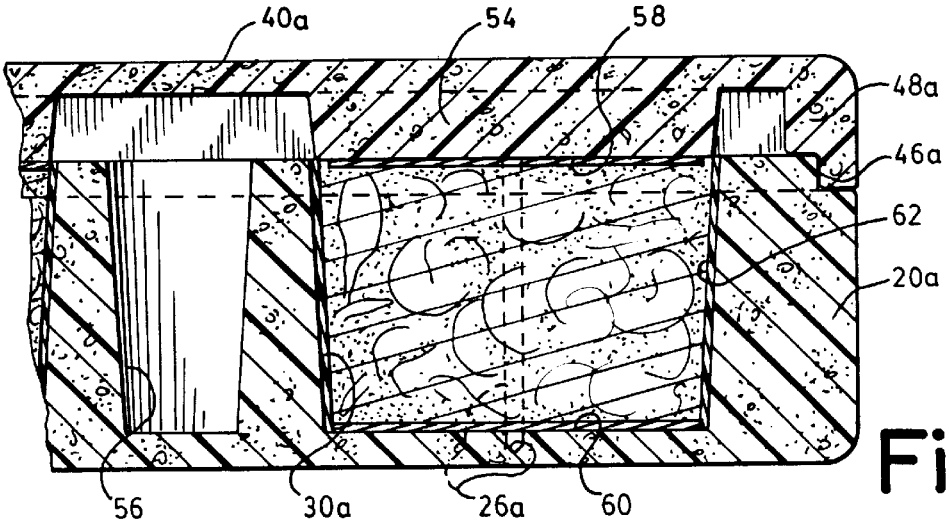
FIG. 5*a* is a partial cross-section of the container of FIG. 9 and its lid.
Figure 9:
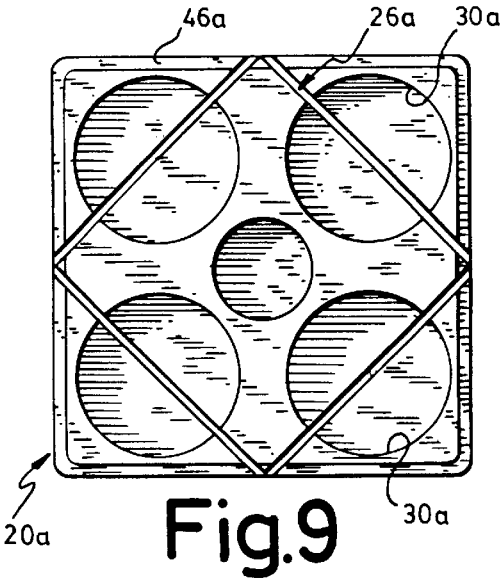
FIG. 9 is a top plan view of a third embodiment of the container.
Figure 10:
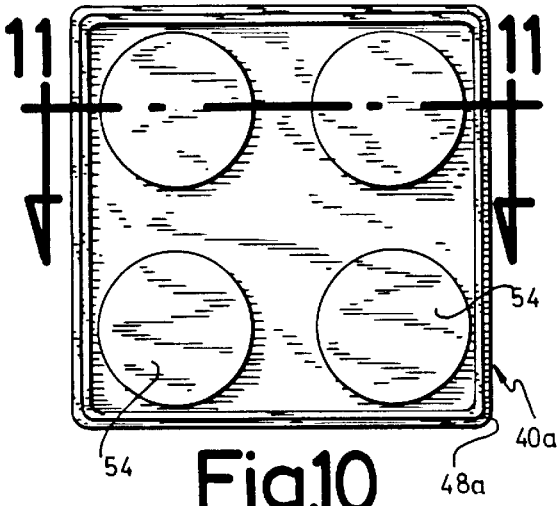
FIG. 10 is a bottom plan view of the lid for the container of FIG. 9.

In the embodiment of FIGS. 5*a*, 9, and 10, lid 40*a* has a dependent, peripheral flange 48*a* which overlaps shoulder 46*a* of container 26*a* as in FIG. 1. Bosses 54 protrude from the underside of lid 40*a* and have a size and shape to mate the top of cavities 30*a* to seal the latter. The remaining portion of lid 40*a* is hollowed out to save foam material. A hollowed out central portion 56 is made in container 20*a* for the same purpose. Otherwise, the container and lid embodiment of FIGS. 5*a*, 9, and 10 is similar to FIGS. 1, 2, and 3.

Figure 12:
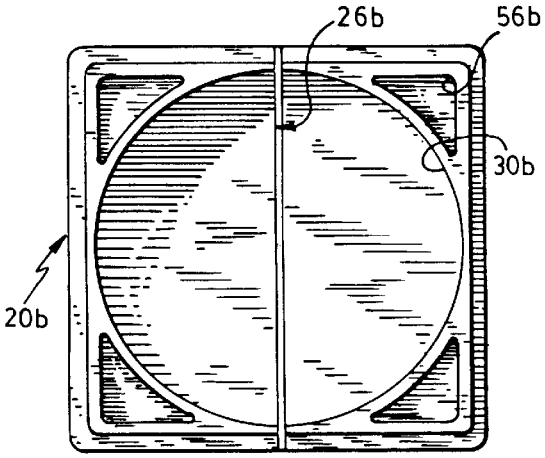
FIG. 12 is a top plan view of a fourth embodiment of the container.

FIG. 12 shows a container 20*b* forming a single cavity 30*b* and a line of weakening 26*b* located in a plane normal to the container bottom and across the maximum width of cavity 30*b*. Container 20*b* has hollowed out corner portions 56*b* for foam material saving.

Figure 13:
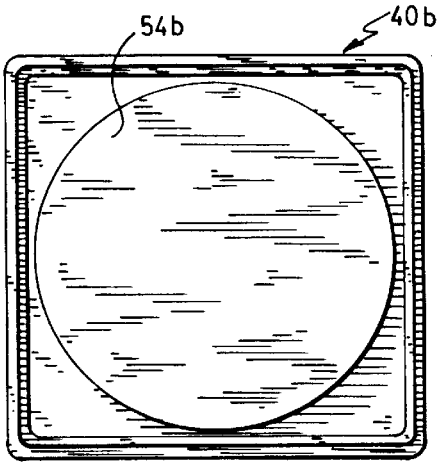
FIG. 13 is a bottom plan view of the lid for the container of FIG. 12.
Figure 11:
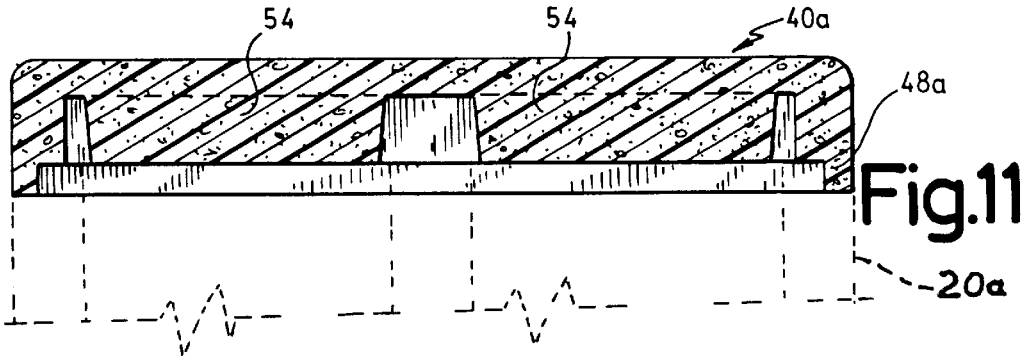
FIG. 11 is a cross-section taken along line 11—11 of FIG. 10.

FIG. 13 shows a lid 40*b* fitting container 20*b* and provided with an underside boss 54*b* mating with and sealing cavity 30*b*.

Figure 14:
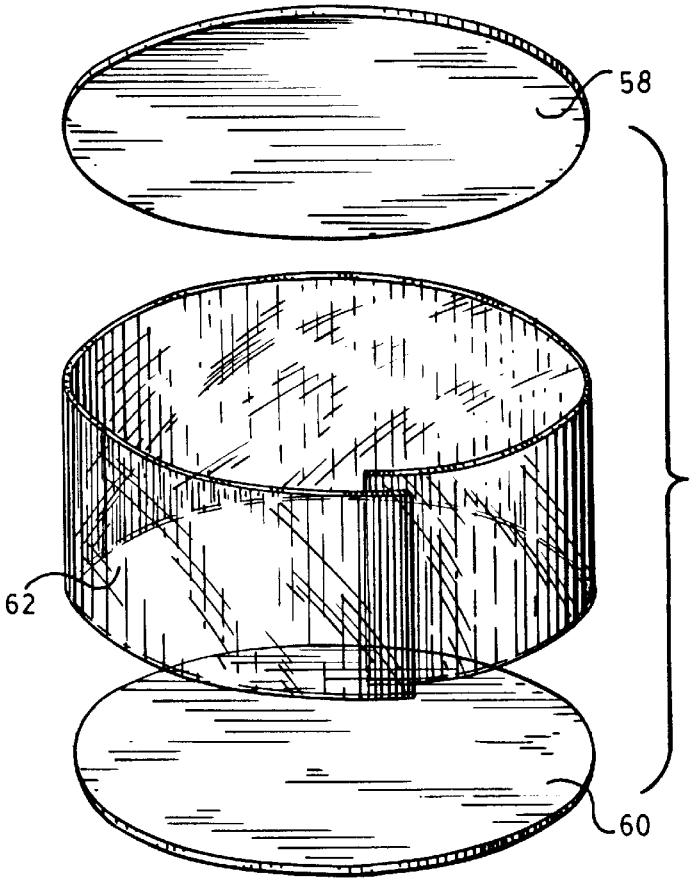
FIG. 14 is view of various released elements forming part of the fourth embodiment.

As shown in FIGS. 5*a* and 14, food release members, for instance pieces of transparent acetate films, are disposed against the inside of each cavity 30, 30*a* or 30*b* to facilitate removal of the food product 32. Top and bottom release members 58 and 60 are in a shape and size to fit the top and bottom of cavities 30, 30*a* or 30*b*. Side release member 62 is in the form of a strip folded to fit the inside of the cavity side wall.

When food product 32 is an ice cream portion topped with a decorative granular material liable to become displaced during handling of the packaged food product, top release member 58 engages this topping and prevents its displacement.

It will be understood that the above-described embodiments are for the purpose of illustration only and that changes and modifications may be made without departing from the spirit and scope of the appended claims.

I claim:

1. A method of forming a packaged food product, and comprising the steps of:

a) supplying a container having a bottom wall and side walls to define a cavity opened at the top and a lid for removably closing said container, both said container and said lid made of a thermal insulating material, said container having an insulating material weakening line extending across said cavity and made in said bottom wall and in said side walls to permit breaking of said container into two parts across said cavity;

b) placing a food release film material within said cavity adjacent said bottom and side walls;

c) filling said cavity with a flowable, settable food product;

d) placing an additional food release film material on top of said food product; and e) closing said container with said lid.

2. A method as defined in claim 1, further including, after step c) the step of topping said food product with a decorative granular material and causing during step e) an inner surface of said lid to engage said additional release film material against said decorative food material to retain the latter in place.

3. A method as defined in claim 1, wherein the container and the lid supplied in step a) are both of a closed cell food grade foam plastic material.

4. The method as defined in claim 3, wherein the step of filling said cavity with a flowable settable food product comprises the step of filling said cavity with a flowable ice cream product.

* * * * *